US011795966B2

(12) United States Patent
Umakoshi et al.

(10) Patent No.: US 11,795,966 B2
(45) Date of Patent: Oct. 24, 2023

(54) BLOWING DEVICE AND COMBUSTION DEVICE INCLUDING SAME

(71) Applicant: NORITZ CORPORATION, Hyogo (JP)

(72) Inventors: Ryosuke Umakoshi, Hyogo (JP); Mikihiro Iwamoto, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/499,867

(22) Filed: Oct. 13, 2021

(65) Prior Publication Data

US 2022/0128065 A1 Apr. 28, 2022

(30) Foreign Application Priority Data

Oct. 23, 2020 (JP) ..... 2020-177970

(51) Int. Cl.

| | |
|---|---|
| ***F04D 29/42*** | (2006.01) |
| ***F23L 5/02*** | (2006.01) |
| ***F04D 17/10*** | (2006.01) |
| ***F04D 17/16*** | (2006.01) |
| ***F04D 29/44*** | (2006.01) |

(52) U.S. Cl.

CPC ..... *F04D 29/4226* (2013.01); *F04D 17/10* (2013.01); *F04D 17/16* (2013.01); *F04D 29/441* (2013.01); *F23L 5/02* (2013.01); *F04D 29/442* (2013.01)

(58) Field of Classification Search

CPC ..... F04D 29/4226; F04D 29/441; F23L 5/02

See application file for complete search history.

(56) References Cited

U.S. PATENT DOCUMENTS 10,119,553 B2 * 11/2018 Son ..... F04D 29/403
2018/0363897 A1 * 12/2018 Ono ..... F23L 5/02

FOREIGN PATENT DOCUMENTS

| | | |
|---|---|---|
| JP | H0318692 | 1/1991 |
| JP | 2017110526 | 6/2017 |
| JP | 2017150472 | 8/2017 |

* cited by examiner

*Primary Examiner* — Michael L Sehn
(74) *Attorney, Agent, or Firm* — JCIPRNET

(57) ABSTRACT

Provided is a blowing device capable of improving a noise reduction effect as compared with a conventional case, and a combustion device including the blowing device is provided. In a rear side shroud of an impeller configuring a blowing device, a first inclined surface portion that is inclined so as to be located frontward toward the radial outer side is formed in a front surface portion of the rear side shroud in a region close to the outer peripheral edge, while a second inclined surface portion that is inclined so as to be located rearward toward the radial outer side is formed in a front surface portion of the rear side shroud in a region closer to the center than the first inclined surface portion.

7 Claims, 5 Drawing Sheets

BLOWING DEVICE AND COMBUSTION DEVICE INCLUDING SAME

CROSS-REFERENCE TO RELATED APPLICATION

This application claims the priority benefits of Japanese application no. 2020-177970, filed on Oct. 23, 2020. The entirety of the above-mentioned patent application is hereby incorporated by reference herein and made a part of this specification.

BACKGROUND

Technical Field

The disclosure relates to a blowing device such as a centrifugal-type blowing device or the like and a combustion device including the same.

Related Art

A specific example of the blowing device is a device as shown in FIG. 7 (for example, see Patent literatures 1 and 2).

In a blowing device Ae shown in FIG. 7, an impeller 1E is accommodated in a casing 2 and is driven and rotated freely by a motor M. The casing 2 includes a front side wall portion 21 having an intake port 24, a rear side wall portion 22, and a peripheral wall portion 20 surrounding an outer periphery of the impeller 1E, and an air flow path 4 connected to an air blowing port 4*a* is formed between the peripheral wall portion 20 and the impeller 1E. During drive rotation of the impeller 1E, air outside the casing 2 is sucked into a central portion on the inner side of the impeller 1E via the intake port 24, then flows out to the air flow path 4 on the outer periphery of the impeller 1E, and is discharged to the outside from the air blowing port 4*a*.

However, in the above-described prior art, there is room for improvement as follows.

That is, the direction in which air flows out from the impeller 1E to the air flow path 4 on the outer periphery thereof is schematically the radial outer side of the impeller 1E as shown by an arrow Ne, but actually, the direction is inclined toward the rear side wall portion 22 side as shown by an arrow Na. This is because the air flow shown by an arrow Nf when the outside air of the casing 2 is sucked into the central portion of the impeller 1E via the intake port 24 is a flow toward the rear side of the casing 2, and the inertia of the flow affects the air outflow from the impeller 1E to the air flow path 4.

On the other hand, when air flows out from the impeller 1E at an inclined angle $\alpha$s shown by the arrow Na as described above, the air strongly collides with the rear side wall portion 22 and becomes a turbulent flow. When the turbulent flow of air occurs, the flow rate of the air fluctuates periodically, and a loud noise is generated as an aerodynamic sound. The blowing device is often required to be quiet, and the above noise is desired to be reduced as much as possible.

Additionally, conventionally, as shown in FIG. 8, a rear side shroud 13 of an impeller 1F is curved and inclined so as to be located on the front side (the upper side of FIG. 8) of the impeller 1F as it progresses to the outer peripheral edge side (see Patent literature 3). According to the configuration, there is a possibility that air flowing radially outward from a part close to the center on the inner side of the impeller 1F is guided by a front surface portion of the rear side shroud 13, and travels in a direction close to a front side direction away from a rear side wall portion 22 of a casing as shown by an arrow Ng.

However, according to this mechanism, in a case that air flows into the central portion on the inner side of the impeller 1F from the front of the impeller 1F and then flows along the front surface portion of the rear side shroud 13 as shown by an arrow Nh in FIG. 8, the air flow direction suddenly changes. Specifically, an angle $\alpha$2 in FIG. 8 is an acute angle.

In order to reduce the noise in the blowing device, it is desirable to avoid the sudden change of the air travelling direction as much as possible, but the mechanism in FIG. 8 does not solve this problem, and there is still room for improvement in reducing noise.

[Patent literature 1] Japanese Patent Laid-Open No. 2017-110526

[Patent literature 2] Japanese Patent Laid-Open No. 2017-150472

[Patent literature 3] Japanese Patent Laid-Open No. 3-18692

SUMMARY

The disclosure provides a blowing device capable of reducing noise as compared with the conventional case and a combustion device including the blowing device.

According to an aspect of the invention, the following technical measures are taken in the disclosure.

A blowing device provided by a first aspect of the disclosure includes: a casing including a front side wall portion forming an intake port for allowing outside air to flow inside, and a rear side wall portion facing the front side wall portion at an interval; and an impeller that is arranged in the casing in a rotatable state between the front side wall portion and the rear side wall portion, wherein the impeller is equipped with a plurality of blades spaced apart from each other in a circumferential direction between a front side shroud and a rear side shroud, and enables air that has flown inside from the intake port to flow outward from a region between the front side shroud and the rear side shroud. A first inclined surface portion that is inclined so as to be located frontward toward a radial outer side is provided in a front surface portion of the rear side shroud of the impeller in a region close to an outer peripheral edge, while a second inclined surface portion that is inclined so as to be located rearward toward the radial outer side is provided in the front surface portion of the rear side shroud in a region closer to a center than the first inclined surface portion.

According to this configuration, the following effects can be obtained. That is, when the impeller is rotated, a part of the air that has flown into the inner side of the impeller through the intake port from the outside is sequentially guided by the second inclined surface portion and the first inclined surface portion of the front surface portion of the rear side shroud, and will travel toward the radial outer side of the impeller. Here, because the second inclined surface portion is inclined so as to be located rearward toward the radial outer side, when the air that has passed through the intake port and entered the inner side of the rear side shroud from the front side thereof flows along the second inclined surface portion, the direction of the air flow does not change sharply (in an acute angle), and the change angle of the air flow direction can be made gentle. That is, the acute angle direction change of the air flow shown by an arrow Nh in FIG. 8 can be prevented from occurring.

On the other hand, because the first inclined surface portion of the rear side shroud is inclined so as to be located frontward toward the radial outer side, the air that is guided by the first inclined surface portion and flows out toward the radial outer side of the impeller can be made to travel close to the front side. That is, the air flow shown by an arrow Na in FIG. 7 that collides with the rear side wall portion of the casing and causes a turbulent flow can be eliminated or reduced.

In this way, according to the disclosure, it is possible to appropriately prevent or suppress both the sudden change of the air traveling direction and the occurrence of the turbulent flow caused by the strong collision of the air flowing out from the impeller with the rear side wall portion of the casing, and thus the noise caused thereby can be reduced, and the quietness can be greatly improved as compared with the prior art.

In an embodiment of the disclosure, the first inclined surface portion and the second inclined surface portion are connected to each other without a step.

According to this configuration, when the air that has entered the region close to the center of the impeller sequentially flows along the second inclined surface portion and the first inclined surface portion of the rear side shroud, the air flow can be made smooth, and the turbulent flow can be made difficult to occur. Thereby, the quietness can be further improved.

In an embodiment of the disclosure, a drive shaft connection region to which a drive shaft of a motor that supports and rotates the impeller is connected is arranged in a central portion of the rear side shroud with an area smaller than that of the intake port, and the second inclined surface portion is located at a rear of a front surface portion of the drive shaft connection region, and extends toward the radial outer side of the drive shaft connection region.

According to this configuration, both the appropriate connection of the impeller to the drive shaft of the motor using the drive shaft connection region in the central portion of the rear side shroud, and the formation of the second inclined surface portion in the rear side shroud can be appropriated achieved.

In an embodiment of the disclosure, the impeller is provided by being sandwiched between respective outer peripheral edges of the front side shroud and the rear side shroud, and has an air outflow opening portion that enables an air outflow to an air flow path, and at least ½ or more of the air outflow opening portion is located in front of the front surface portion of the drive shaft connection region.

According to this configuration, because the air outflow opening portion of the impeller is located well forward with reference to the front surface portion of the drive shaft connection region, an arrangement can be set in which the impeller and the motor are brought close to each other to shorten the dimension of the drive shaft of the motor and suppress the vibration of the impeller, and the air outflow opening portion of the impeller is separated from the rear side wall portion of the casing toward the front side thereof by a relatively large dimension. Therefore, the noise when the impeller is rotated can be further reduced.

In an embodiment of the disclosure, a third inclined surface portion that is inclined so as to be located frontward toward the radial outer side is provided in a rear surface portion of the front side shroud in a region close to the outer peripheral edge, while a fourth inclined surface portion that is inclined so as to be located rearward toward the radial outer side is provided in a rear surface portion of the front side shroud in a region closer to the center than the third inclined surface portion.

According to this configuration, the third inclined surface portion and the fourth inclined surface portion of the front side shroud of the impeller correspond to the first inclined surface portion and the second inclined surface portion of the rear side shroud, and the following condition is more thoroughly suppressed, that is, when air that has entered a region close to the center on the inner side of the impeller from the intake port travels toward the radial outer side of the impeller, the air flow suddenly changes. In addition, the collision with the rear side wall portion of the casing when the air flows out to the air flow path on the radial outer side of the impeller is also more thoroughly suppressed. Therefore, it is more preferable in reducing noise and achieving excellent quietness.

A combustion device provided by a second aspect of the disclosure includes: a burner; and a blowing device for supplying combustion air to the burner. The blowing device provided by the first aspect of the invention is used as the blowing device.

According to this configuration, the same effects as described for the blowing device provided by the first aspect of the disclosure can be obtained.

Other features and advantages of the disclosure will be more apparent from the following description of embodiments of the invention that is made with reference to the accompanying drawings.

DESCRIPTION OF THE EMBODIMENTS

A preferable embodiment of the disclosure is specifically described below with reference to the drawings.

Figure 7:
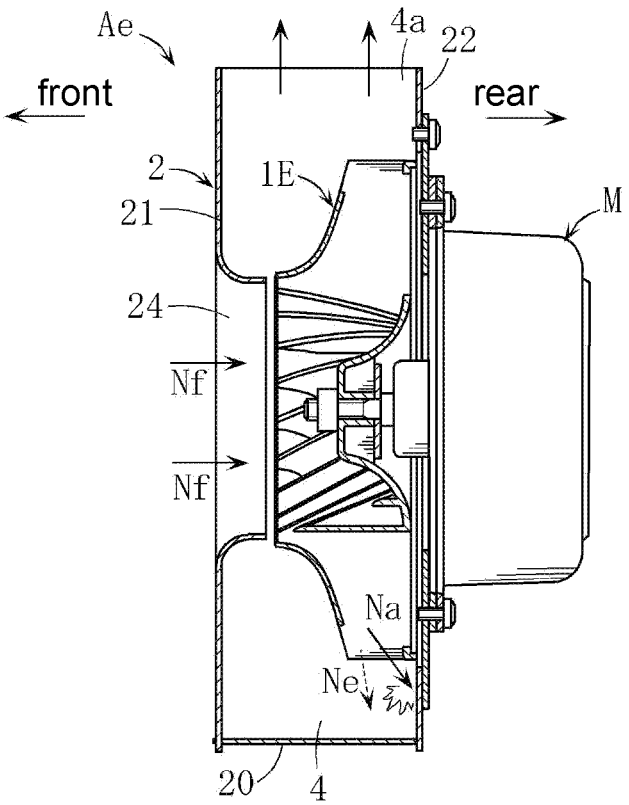
FIG. 7 is a cross-sectional view showing an example of the prior art.
Figure 8:
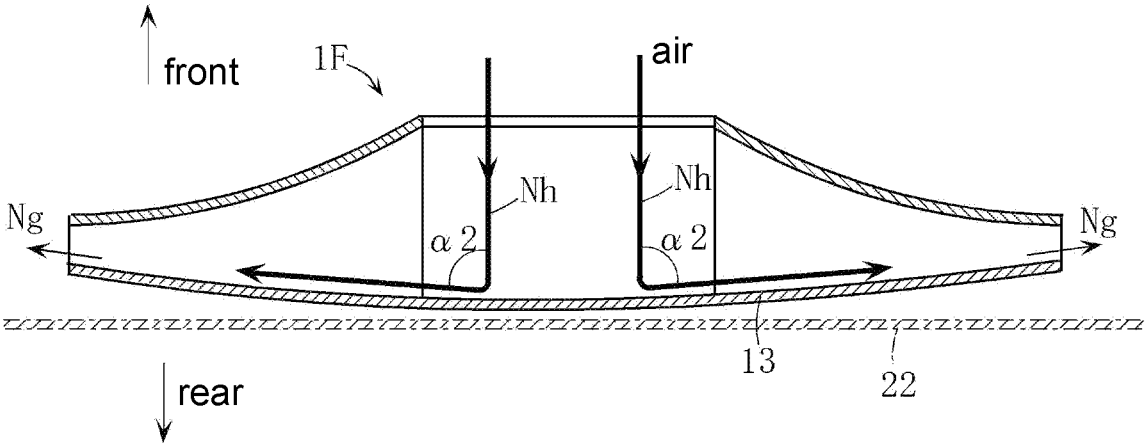
FIG. 8 is a cross-sectional view showing another example of the prior art.

Note that, for ease of understanding, the same reference numerals as those shown in FIG. 7 and FIG. 8 are appropriately used for the same or similar elements as those of the prior art shown in FIG. 7 and FIG. 8.

Figure 1:
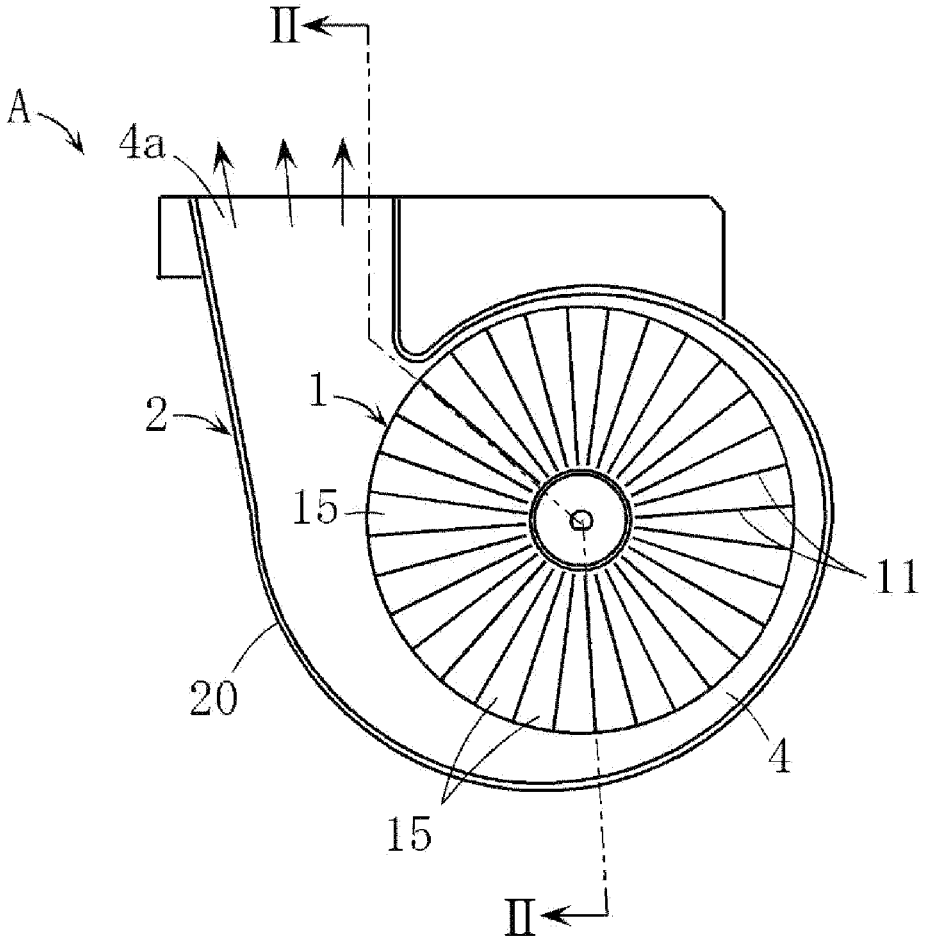
FIG. 1 is a front cross-sectional view showing a simplified example of a blowing device according to the disclosure.
Figure 2A:
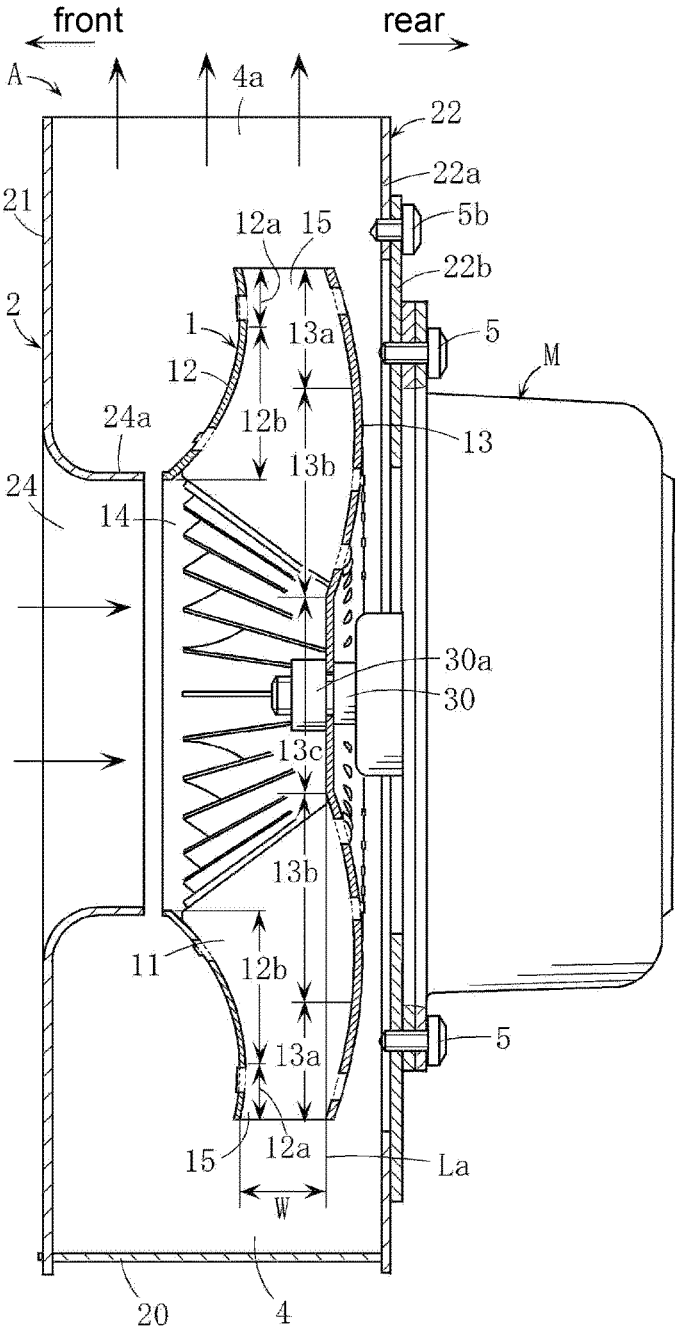
FIG. 2A is a cross-sectional view taken along a line II-II of FIG. 1.
Figure 2B:
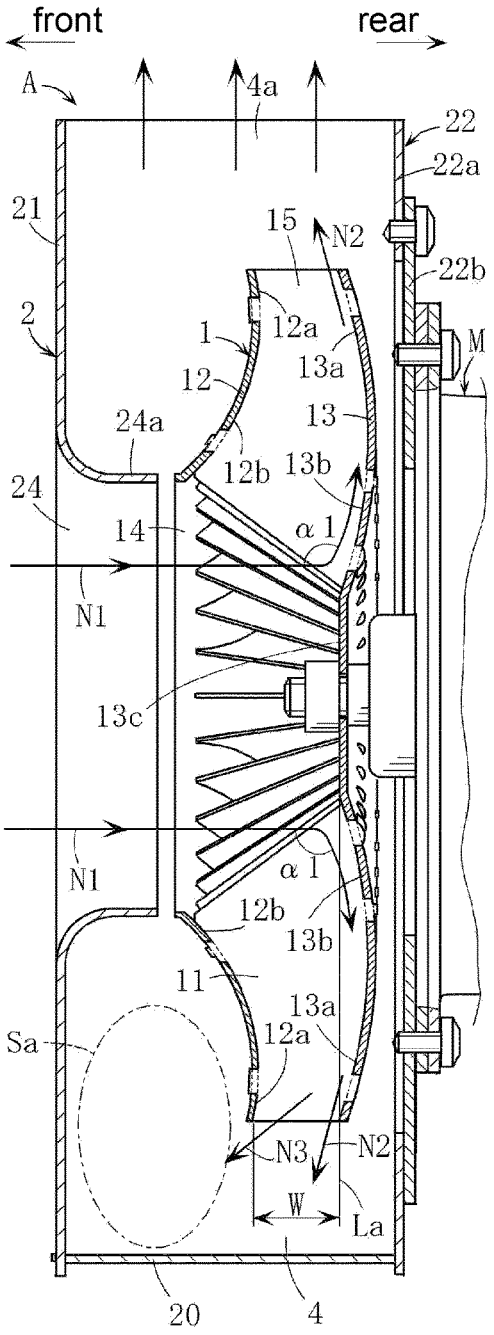
FIG. 2B is an action illustration diagram of FIG. 2A.
Figure 3:
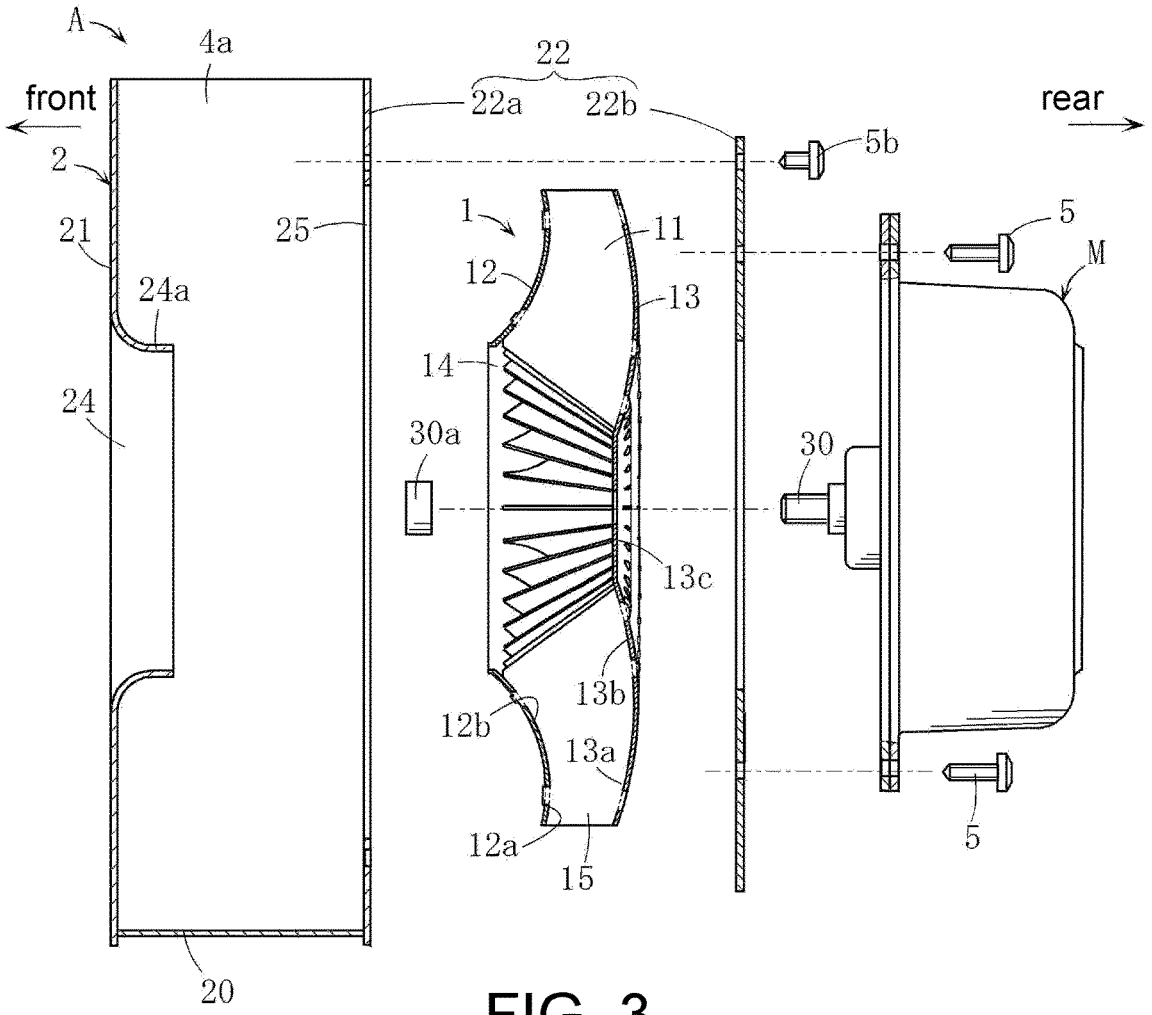
FIG. 3 is an exploded cross-sectional view of FIG. 2A.

A blowing device A shown in FIGS. 1 to 3 is a centrifugal-type blowing device. As is well shown in FIG. 2A, FIG. 2B and FIG. 3, the blowing device A includes an impeller 1, a casing 2 that accommodates the impeller 1 inside, and a motor M for drive rotation of the impeller 1.

Figure 4:
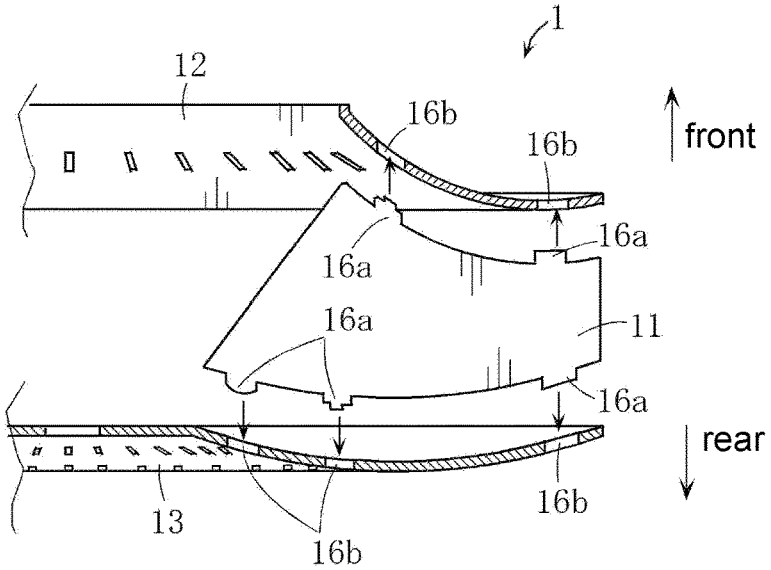
FIG. 4 is a main part exploded cross-sectional view of an impeller of the blowing device shown in FIGS. 1 to 3.

The impeller 1 includes a front side shroud 12, a rear side shroud 13, and a plurality of blades 11. As shown in FIG. 1, the plurality of blades 11 are radially arranged to line up at an interval in a circumferential direction of the impeller 1, and extend substantially linearly in a radial direction, and the blowing device A in the embodiment is configured as a radial fan. The front side shroud 12 has a hollow disk shape in which an intake opening portion 14 is formed in a central portion, and is located in front of the plurality of blades 11. The rear side shroud 13 has a disk shape having substantially the same outer diameter as the front side shroud 12, and is located at the rear of the plurality of blades 11. As shown in FIG. 4, a plurality of hole portions 16*b* into which a plurality of convex portions 16*a* for caulking, which are respectively protruded from the front part and the rear part of each blade 11 are inserted, are arranged in the front side shroud 12 and the rear side shroud 13. By caulking the convex portions 16*a*, the front side shroud 12 and the rear side shroud 13 are connected to the plurality of blades 11.

The detailed shape of the front side shroud 12 and the rear side shroud 13 is described later.

As is well shown in FIG. 2A, FIG. 2B and FIG. 3, the casing 2 has a front side wall portion 21, a rear side wall portion 22, and a peripheral wall portion 20. The peripheral wall portion 20 surrounds an outer periphery of the impeller 1 and has an air blowing port 4*a* at the upper part. An air flow path 4 guiding the air flowing out from the impeller 1 to the air blowing port 4*a* is formed between an outer peripheral distal end portion of the impeller 1 and the peripheral wall portion 20 of the casing 2. The front side wall portion 21 has an intake port 24 and a tubular guide portion 24*a* having an inward projection shape and formed on a peripheral edge portion of the intake port 24.

The rear side wall portion 22 of the casing 2 is configured by combining a main rear side wall portion 22*a* connected to the peripheral wall portion 20 and an auxiliary rear side wall portion 22*b* different from the main rear side wall portion 22*a*. An opening portion 25 having a diameter larger than that of the impeller 1 is formed in the main rear side wall portion 22*a*. The opening portion 25 is used as an entrance/exit port of the impeller 1 during assembly work and maintenance of the blowing device A. The auxiliary rear side wall portion 22*b* is a section that closes the opening portion 25 and serves as an attachment plate for attaching the motor M, and the auxiliary rear side wall portion 22*b* is attached to the main rear side wall portion 22*a* via a screw 5*b*. The motor M is attached to the auxiliary rear side wall portion 22*b* via screws 5.

In the rear side shroud 13 of the impeller 1, a peripheral region of a drive shaft connection region 13*c* located in the central portion is curved, and a front surface portion of the curved region is formed as a first inclined surface portion 13*a* and a second inclined surface portion 13*b*.

The drive shaft connection region 13*c* of the rear side shroud 13 is a region used for connecting a drive shaft 30 of the motor M, and is a flat plate-like region located in a central portion of the rear side shroud 13 with an area smaller than an opening area of the intake port 24 (and the intake opening portion 14). The drive shaft 30 of the motor M penetrates through the drive shaft connection region 13*c*, a nut 30*a* screwed into the drive shaft 30 is tightened in the drive shaft connection region 13*c*, and the drive shaft 30 and the rear side shroud 13 are connected. Thereby, the impeller 1 is supported by the drive shaft 30 of the motor M to be rotatable.

The second inclined surface portion 13*b* of the rear side shroud 13 is located on the periphery of the drive shaft connection region 13*c* and connected to the drive shaft connection region 13*c*, and is located closer to the center of the rear side shroud 13 than the first inclined surface portion 13*a*. The second inclined surface portion 13*b* is inclined so as to be located rearward as it progresses toward the radial outer side. Therefore, the second inclined surface portion 13*b* is located at the rear of a front surface portion of the drive shaft connection region 13*c* in a front-rear direction of the blowing device A. In addition, a part (a central side part) of the second inclined surface portion 13*b* faces the intake port 24 (and the intake opening portion 14).

The first inclined surface portion 13*a* of the rear side shroud 13 is arranged close to the outer peripheral edge of the rear side shroud 13, and is located on an outer periphery of the second inclined surface portion 13*b* and connected to the second inclined surface portion 13*b*. Contrary to the second inclined surface portion 13*b*, the first inclined surface portion 13*a* is inclined so as to be located on the front side as it progresses toward the radial outer side.

In the embodiment, the first inclined surface portion 13*a* and the second inclined surface portion 13*b* both have a curved shape, and are connected to each other without a step. As a whole, the first inclined surface portion 13*a* and the second inclined surface portion 13*b* form one concave curved surface recessed rearward.

The front side shroud 12 is curved in the same form as the above-described curved region of the rear side shroud 13, and includes a third inclined surface portion 12*a* and a fourth inclined surface portion 12*b* as a rear surface portion of the front side shroud 12. The third inclined surface portion 12*a* is a rear surface portion in a region close to the outer peripheral edge of the front side shroud 12, and is inclined so as to be located frontward toward the radial outer side. The fourth inclined surface portion 12*b* is a rear surface portion in a region closer to the center of the front side shroud 12 than the third inclined surface portion 12*a*, and is inclined so as to be located rearward toward the radial outer side. These third inclined surface portion 12*a* and fourth inclined surface portion 12*b* both have a curved shape, and are connected to each other without a step. As a whole, the third inclined surface portion 12*a* and the fourth inclined surface portion 12*b* form one convex curved surface protruded rearward.

An air outflow opening portion 15 is formed between the respective outer peripheral edges of the front side shroud 12 and the rear side shroud 13 of the impeller 1, and is configured in a manner that the air that has entered the central region of the impeller 1 from the outside of the casing 2 via the intake port 24 flows out from the opening portion 15 to the air flow path 4 on the outer periphery of the impeller 1. Here, in the embodiment, substantially the entire opening portion 15 having a front-rear width W is set to be located in front of the front surface portion (an extension line La of the front surface portion) of the drive shaft connection region 13*c* based on the fact that the rear side shroud 13 has the above curved shape.

Figure 5:
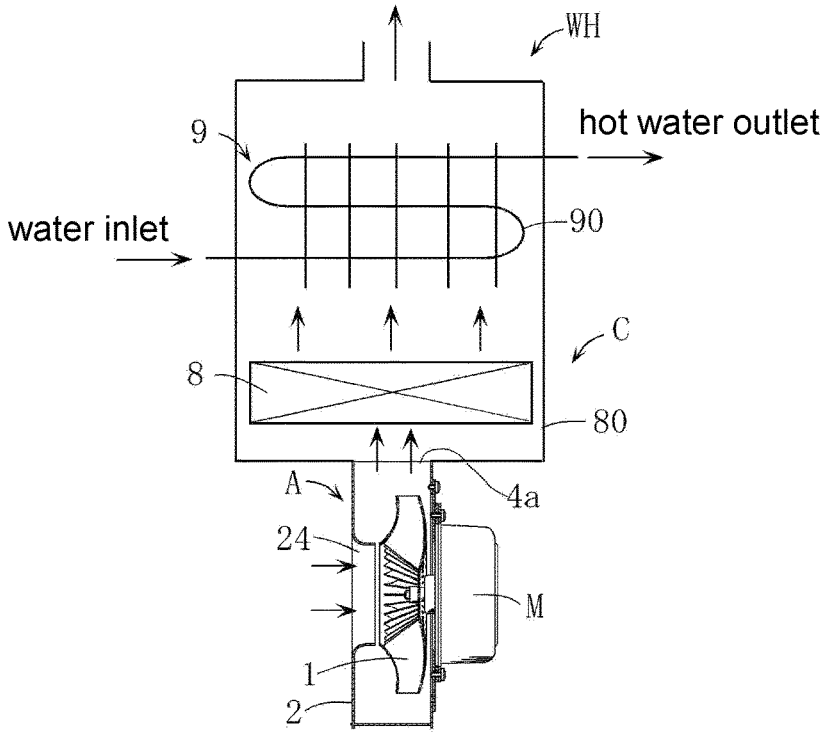
FIG. 5 is a main part cross-sectional view showing an example of a combustion device including the blowing device shown in FIGS. 1 to 3 and a hot water supply device using the combustion device.

The blowing device A described above is used as, for example, a constituent element of a combustion device C configuring a hot water supply device WH as shown in FIG. 5.

The hot water supply device WH shown in FIG. 5 includes the combustion device C and a heat exchanger 9, the combustion device C includes a burner 8 arranged in a case 80, and the blowing device A can supply combustion air to the burner 8. The heat exchanger 9 includes a heat transfer tube 90, and by recovering heat from combustion gas generated by the burner 8, the water flowing in the heat transfer tube 90 is heated to generate warm water.

Next, the action of the blowing device A described above is described.

First, when the impeller 1 is rotated, as shown by an arrow N1 in FIG. 2B, the air outside the casing 2 flows in from the intake port 24 to the vicinity of the central portion on the inner side of the impeller 1, and a part of the air will travel toward the radial outer side along the front surface portion of the rear side shroud 13. At that time, the air is guided by the second inclined surface portion 13*b* of the rear side shroud 13, but because the second inclined surface portion 13*b* is located rearward toward the radial outer side, a direction change angle α1 of the air is prevented from being an acute angle, and an action of suppressing a sudden change of the air flow direction is obtained. An effect of reducing noise can also be exhibited thereby.

Next, the above-described air flows out from the opening portion 15 to the air flow path 4 in a state of being guided by the first inclined surface portion 13*a* of the rear side shroud 13, and the first inclined surface portion 13*a* is inclined so as to be located frontward toward the radial outer side as described above. Therefore, the air flowing out from the opening portion 15 to the air flow path 4 travels in a direction away from the rear side wall portion 22 of the casing 2 as shown by an arrow N2. As a result, strong collision of the air with the rear side wall portion 22 and occurrence of the turbulent flow are appropriately prevented or suppressed, and the noise serving as an aerodynamic sound caused by the turbulent flow of the air can be effectively reduced.

When air flows out from the opening portion 15 of the impeller 1 to the air flow path 4, a large amount of air flows in the direction shown by an arrow N3 in FIG. 2B are also generated. However, this air flow travels toward a space region Sa having a relatively large volume, which is formed on the inner side of the casing 2. Therefore, the air flow shown by the arrow N3 described above does not generate large noise as well.

A part of the air traveling from the intake port 24 to the central portion region on the inner side of the impeller 1 sequentially flows along the second inclined surface portion 13*b* and the first inclined surface portion 13*a* of the rear side shroud 13, and these first inclined surface portion 13*a* and second inclined surface portion 13*b* are connected in a smooth state without a step as described above. Therefore, the above flow of air becomes smooth, which is more preferable in noise reduction.

As described above, the front side shroud 12 of the impeller 1 has the third inclined surface portion 12*a* and the fourth inclined surface portion 12*b* which are inclined in the same manner as the first inclined surface portion 13*a* and the second inclined surface portion 13*b* of the rear side shroud 13. Therefore, it is possible to more thoroughly prevent the sudden change of the flow of air that has entered the region close to the center on the inner side of the impeller 1 from the intake port 24 when the air travels toward the radial outer side of the impeller, and the collision of the air with the rear side wall portion 22 of the casing 2 when the air flows out to the air flow path 4 on the radial outer side of the impeller 1. As a result, the quietness can be further improved.

In the embodiment, substantially the entire width of the air outflow opening portion 15 of the impeller 1 is located in front of the front surface portion of the drive shaft connection region 13*c*; according to this configuration, the impeller 1 is supported in a state that the drive shaft 30 of the motor M is set to be relatively short, the vibration of the impeller 1 when the impeller 1 is rotated is suppressed, and the air outflow opening portion 15 can be appropriately separated from the rear side wall portion 22 toward the front side thereof. If the opening portion 15 is separated from the rear side wall portion 22 toward the front side thereof, the air is prevented from strongly striking the rear side wall portion 22 and the noise prevention effect is improved correspondingly.

Figure 6:
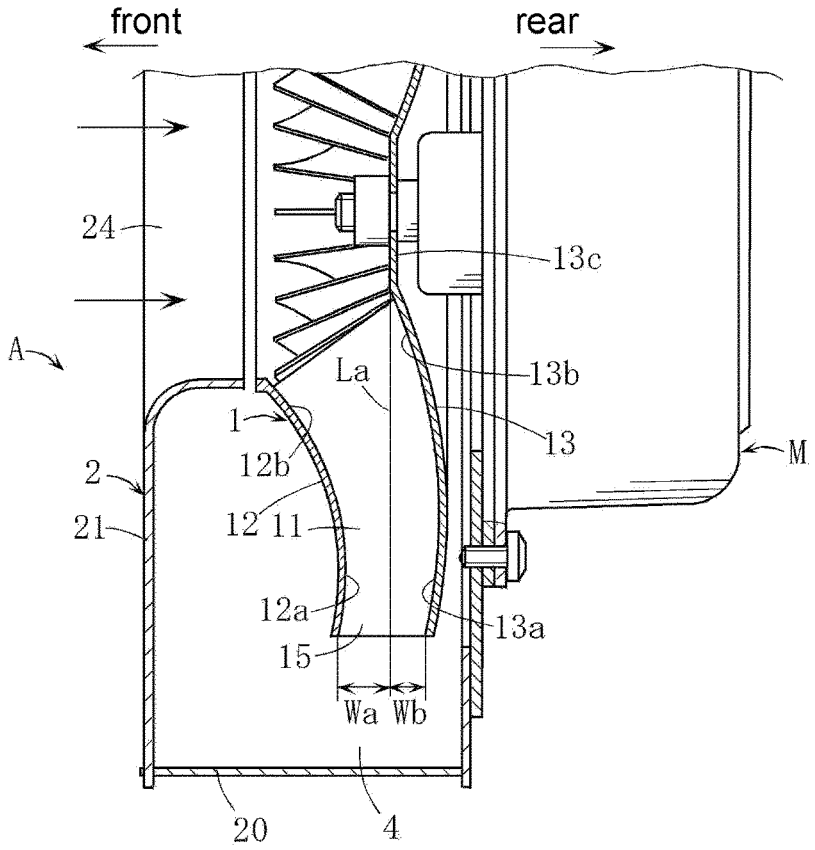
FIG. 6 is a main part cross-sectional view showing another example of the disclosure.

FIG. 6 shows another embodiment of the disclosure. In FIG. 6, elements that are the same as or similar to those of the above-described embodiment are designated by the same reference numerals as those of the above-described embodiment, and duplicate description is omitted.

In the embodiment shown in FIG. 6, the extension line La of the front surface portion of the drive shaft connection region 13*c* of the impeller 1 is located at a position crossing the air outflow opening portion 15, and at least ½ or more of the front-rear width of the opening portion 15 is located in front of the front surface portion (the extension line La thereof). That is, Wa and Wb in FIG. 6 have a relationship of Wa≥Wb.

According to this configuration, the air outflow opening portion 15 is located well forward with reference to the front surface portion of the drive shaft connection region 13*c*. Therefore, it is preferable to set an arrangement, similar to the above-described embodiment, in which the dimension of the drive shaft 30 of the motor M is shortened, the vibration of the impeller is suppressed, and the air outflow opening portion 15 is separated from the rear side wall portion 22 of the casing 2 toward the front side thereof.

Additionally, in the disclosure, a configuration can also be adopted in which the entire air outflow opening portion 15 is located at the rear of the front surface portion of the drive shaft connection region 13*c*.

The disclosure is not limited to the contents of the above-described embodiments. The specific configuration of each part of the blowing device and the combustion device according to the disclosure can be designed and changed in various ways within the indented scope of the disclosure.

In the above-described embodiment, the first inclined surface portion 13*a* and the second inclined surface portion 13*b* of the rear side shroud 13 of the impeller 1 both have a curved shape; alternatively, both or one of them can also be configured as an inclined surface portion having a planar shape.

In addition, in the above-described embodiment, the first inclined surface portion 13*a* and the second inclined surface portion 13*b* have a configuration of being adjacent to each other and directly connected to each other, but the disclosure is not limited thereto. For example, a configuration can also be adopted in which a non-inclined intermediate region is formed between the first inclined surface portion 13*a* and the second inclined surface portion 13*b*, and the first inclined surface portion 13*a* and the second inclined surface portion 13*b* are connected to each other via the intermediate region.

It is sufficient if the first inclined surface portion referred to in the disclosure is formed in the region close to the outer peripheral edge of the rear side shroud, and the second inclined surface portion is formed in the region closer to the center than the first inclined surface portion, and the specific size (area) thereof, the ratio thereof, and the like are not limited. The specific inclined angle thereof is also not limited. The same applies to the third inclined surface portion 12*a* and the fourth inclined surface portion 12*b* of the front side shroud 12.

The rear side wall portion of the casing is not limited to the configuration in which the main rear side wall portion 22*a* and the auxiliary rear side wall portion 22*b* are combined as in the above-described embodiment, and a configuration formed by, for example, using only one plate-shaped member without using a member corresponding to the auxiliary rear side wall portion 22*b* (a configuration in which the motor is directly attached to the main rear side wall portion 22*a*) can also be adopted.

The blowing device A of the above-described embodiment is configured as a radial fan in which each of the plurality of blades 11 extends substantially linearly in the radial direction; alternatively, the blowing device A can also be configured as, for example, a turbo fan or the like having a configuration in which each of the plurality of blades is curved. It should be noted that the radial fan can control the air flow more accurately by the disclosure than the turbo fan, and the case where the disclosure is applied to a radial fan rather than a turbo fan can obtain an excellent noise reduction effect.

The blowing device according to the disclosure can also be used for other applications instead of being used as a constituent element of the combustion device. In addition, the combustion device according to the disclosure is not limited to the use for the hot water supply device, and can also be configured as, for example, a combustion device for heating or the like, and the purpose and the application of combustion are not limited.

What is claimed is:

1. A blowing device, comprising:

a casing comprising a front side wall portion forming an intake port for allowing an air outside to flow inside, and a rear side wall portion facing the front side wall portion at an interval; and an impeller that is arranged in the casing in a rotatable state between the front side wall portion and the rear side wall portion, wherein the impeller is equipped with a plurality of blades spaced apart from each other in a circumferential direction between a front side shroud and a rear side shroud, and enables the air that has flown inside from the intake port to flow outward from a region between the front side shroud and the rear side shroud, wherein a first inclined surface portion that is inclined so as to be located frontward toward a radial outer side is provided in a front surface portion of the rear side shroud of the impeller in a region close to an outer peripheral edge of the rear side shroud, while a second inclined surface portion that is inclined so as to be located rearward toward the radial outer side is provided in the front surface portion of the rear side shroud in a region closer to a center of the impeller than the first inclined surface portion, a third inclined surface portion that is inclined so as to be located frontward toward the radial outer side is provided in a rear surface portion of the front side shroud in a region close to the outer peripheral edge, while a fourth inclined surface portion that is inclined so as to be located rearward toward the radial outer side is provided in a rear surface portion of the front side shroud in a region closer to the center than the third inclined surface portion;

wherein the second inclined surface portion is configured to change an angle of the air to an obtuse angle between a first direction and a second direction, the first direction is a direction in which the air is outside the casing flows in from the intake port to a vicinity of a central portion on an inner side of the impeller, and the second direction is a direction in which the air is guided by the second inclined surface portion;

wherein the impeller is provided by being sandwiched between respective outer peripheral edges of the front side shroud and the rear side shroud, and has an air outflow opening portion that enables an air outflow to an air flow path;

wherein a space region is provided on a front side of the front side shroud in the casing, the space region having a volume is disposed opposite to the air outflow opening portion, the space region is configured to make the air travel from the air outflow opening portion through the air flow path to the space region, and a front-rear width of the space region is larger than a front-rear width of the air outflow opening portion.

2. The blowing device according to claim 1, wherein the first inclined surface portion and the second inclined surface portion are connected to each other without a step.

3. The blowing device according to claim 2, wherein a drive shaft connection region to which a drive shaft of a motor that supports and rotates the impeller is connected is arranged in the central portion of the rear side shroud with an area smaller than that of the intake port, and the second inclined surface portion is located at a rear of a front surface portion of the drive shaft connection region, and extends toward the radial outer side of the drive shaft connection region.

4. The blowing device according to claim 3, wherein at least ½ of the air outflow opening portion is located in front of the front surface portion of the drive shaft connection region.

5. The blowing device according to claim 1, wherein a drive shaft connection region to which a drive shaft of a motor that supports and rotates the impeller is connected is arranged in the central portion of the rear side shroud with an area smaller than that of the intake port, and the second inclined surface portion is located at a rear of a front surface portion of the drive shaft connection region, and extends toward the radial outer side of the drive shaft connection region.

6. The blowing device according to claim 5, wherein at least ½ of the air outflow opening portion is located in front of the front surface portion of the drive shaft connection region.

7. A combustion device, comprising:

a burner; and a blowing device for supplying combustion air to the burner, wherein the blowing device according to claim 1 is used as the blowing device.

* * * * *